US007456584B2

(12) United States Patent
Itoh

(10) Patent No.: US 7,456,584 B2
(45) Date of Patent: Nov. 25, 2008

(54) LIGHT EMITTING ELEMENT DRIVING APPARATUS, METHOD OF DRIVING A LIGHT EMITTING ELEMENT AND COMPUTER READABLE RECORDING MEDIUM

(75) Inventor: Takashi Itoh, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 68 days.

(21) Appl. No.: 11/717,910

(22) Filed: Mar. 14, 2007

(65) Prior Publication Data

US 2007/0216615 A1 Sep. 20, 2007

(30) Foreign Application Priority Data

Mar. 15, 2006 (JP) ..... 2006-071504
Jan. 15, 2007 (JP) ..... 2007-005279

(51) Int. Cl.
*H05B 37/02* (2006.01)
*G05F 1/00* (2006.01)

(52) U.S. Cl. ..... 315/224; 315/291

(58) Field of Classification Search ..... None
See application file for complete search history.

(56) References Cited

U.S. PATENT DOCUMENTS 7,007,176 B2 * 2/2006 Goodfellow et al. ..... 713/300
7,218,293 B2 * 5/2007 Kato ..... 345/76
7,256,554 B2 * 8/2007 Lys ..... 315/291
2006/0175983 A1 * 8/2006 Crouse et al. ..... 315/291

FOREIGN PATENT DOCUMENTS

| | | | |
|---|---|---|---|
| JP | 11-41921 | A | 2/1999 |
| JP | 2003-317979 | A | 11/2003 |
| JP | 2005-14829 | A | 1/2005 |
| JP | 2005-160178 | A | 6/2005 |
| JP | 2006-49423 | A | 2/2006 |
| JP | 2006-50894 | A | 2/2006 |
| JP | 2006-174677 | A | 6/2006 |

* cited by examiner

*Primary Examiner*—David Hung Vu
*Assistant Examiner*—Minh Dieu A
(74) *Attorney, Agent, or Firm*—Frishauf, Holtz, Goodman & Chick, P.C.

(57) ABSTRACT

A light emitting element driving apparatus for driving a light emitting element, includes driving means for a executing PWM driving operation to drive the light emitting element at a predetermined duty cycle and for executing a soft-start driving operation during each ON-period in the PWM driving operation. During the soft-start driving operation, a current value of current supplied to the light emitting element is increased from a first constant current value up to a second constant current value. The driving apparatus includes parameter adjusting means for controlling the driving means such that the second constant current value is supplied to the light emitting element for a period that is longer than a period from a beginning of the ON-period to a time at which the current value of the current supplied to the light emitting element reaches the second constant current value.

11 Claims, 7 Drawing Sheets

| A2 | Ton | Tb | Tc | Td |
|---|---|---|---|---|
| 200.0 | 250.0 | 100.0 | 200.0 | 50.0 |
| 199.0 | 251.3 | 99.0 | 199.0 | 52.3 |
| 198.0 | 252.5 | 98.0 | 198.0 | 54.5 |
| 197.0 | 253.8 | 97.0 | 197.0 | 56.8 |
| 169.0 | 255.1 | 69.0 | 169.0 | 59.1 |
| 195.0 | 256.4 | 95.0 | 195.0 | 61.4 |
| 194.0 | 257.7 | 94.0 | 194.0 | 63.7 |
| 193.0 | 259.1 | 93.0 | 193.0 | 66.1 |
| 192.0 | 260.4 | 92.0 | 192.0 | 68.4 |
| 191.0 | 261.8 | 91.0 | 191.0 | 70.8 |
| 190.0 | 263.2 | 90.0 | 190.0 | 73.2 |
| 189.0 | 264.6 | 89.0 | 189.0 | 75.6 |
| 188.0 | 266.0 | 88.0 | 188.0 | 78.0 |
| 187.0 | 267.4 | 87.0 | 187.0 | 80.4 |
| 186.0 | 268.8 | 86.0 | 186.0 | 82.8 |
| 185.0 | 270.3 | 85.0 | 185.0 | 85.3 |
| 184.0 | 271.7 | 84.0 | 184.0 | 87.7 |
| 183.0 | 273.2 | 83.0 | 183.0 | 90.2 |
| 182.0 | 274.7 | 82.0 | 182.0 | 92.7 |
| 181.0 | 276.2 | 81.0 | 181.0 | 95.2 |
| 180.0 | 277.8 | 80.0 | 180.0 | 97.8 |
| 179.0 | 279.3 | 79.0 | 179.0 | 100.3 |
| 178.0 | 280.9 | 78.0 | 178.0 | 102.9 |
| 177.0 | 282.5 | 77.0 | 177.0 | 105.5 |
| 176.0 | 284.1 | 76.0 | 176.0 | 108.1 |
| 175.0 | 285.7 | 75.0 | 175.0 | 110.7 |
| 174.0 | 287.4 | 74.0 | 174.0 | 113.4 |
| 173.0 | 289.0 | 73.0 | 173.0 | 116.0 |
| 172.0 | 290.7 | 72.0 | 172.0 | 118.7 |
| 171.0 | 292.4 | 71.0 | 171.0 | 121.4 |
| 170.0 | 294.1 | 70.0 | 170.0 | 124.1 |
| 169.0 | 295.9 | 69.0 | 169.0 | 126.9 |
| 168.0 | 297.6 | 68.0 | 168.0 | 129.6 |
| 167.0 | 299.4 | 67.0 | 167.0 | 132.4 |
| 166.0 | 301.2 | 66.0 | 166.0 | 135.2 |
| 165.0 | 303.0 | 65.0 | 165.0 | 138.0 |
| 164.0 | 304.9 | 64.0 | 164.0 | 140.9 |
| 163.0 | 306.7 | 63.0 | 163.0 | 143.7 |
| 162.0 | 308.6 | 62.0 | 162.0 | 146.6 |
| 161.0 | 310.6 | 61.0 | 161.0 | 149.6 |
| 160.0 | 312.5 | 60.0 | 160.0 | 152.5 |
| 159.0 | 314.5 | 59.0 | 159.0 | 155.5 |
| **158.0** | **316.5** | **58.0** | **158.0** | **158.5** |

FIG.6

LIGHT EMITTING ELEMENT DRIVING APPARATUS, METHOD OF DRIVING A LIGHT EMITTING ELEMENT AND COMPUTER READABLE RECORDING MEDIUM

CROSS-REFERENCE TO RELATED APPLICATIONS

This application is based on Japanese Patent Applications No. 2006-71504 filed on Mar. 15, 2006, and No. 2007-5279 filed on Jan. 15, 2007, the entire contents of which are incorporated herein by reference.

BACKGROUND OF THE INVENTION

1. Field of the Invention

The present invention relates to a light emitting element driving apparatus, a method of driving a light emitting element and a computer readable recording medium storing a computer program for driving a light emitting element. The light emitting element driving apparatus executes a pulse width modulation (PWM) driving operation at a predetermined duty cycle and further executes a soft-start driving operation during each ON-period in the PWM driving operation. During the soft-start driving operation, current to be supplied to the light emitting element is increased from a first constant current value up to a second constant current value.

2. Description of the Related Art

Light-Emitting Diodes (LEDs) are widely used for various purposes. For example, in battery-driven mobile devices such as cellular phones and PDAs (Personal Data Assistants), an LED or a light-emitting device is used as a backlight for an LCD (Liquid Crystal Display), and an LED is also used as a flash for a CCD (Charge-Coupled Device) camera built in such a mobile device. LEDs having different luminescent colors are also driven in a flashing manner to be used for various purposes.

Various techniques are used for driving an LED with a constant current to make the LED emit light stably. For example, a pulse width modulation (PWM) driving technique has been proposed for supplying current to an LED to enable stable light emission. The PWM driving technique drives the LED by repeating a first period Ton, in which the LED is turned on, and a second period Toff, in which the LED is turned off, with a duty cycle Dt (e.g., 1 ms.), which is faster than human recognition, as shown in FIG. 8A.

Meanwhile, a technique called a "Soft-Start" driving operation has been proposed for preventing inrush current. In the "Soft-Start" driving operation, current is supplied to the LED during a predetermined period Ta with a first constant current value A1 and the current increases to a second current value A2, as shown in FIG. 8B.

For example, a voltage booster type circuit, which executes such a "Soft-Start" driving operation is disclosed in Japanese Non-examined Patent Publication No. 2005-160178.

A voltage booster type circuit, such as the one disclosed in JP 2005-160178, often has a minimum current value of current that should be supplied to the LED for stable driving. For example, as shown in FIG. 9, fluctuation of current supplied to the LED due to environmental temperature changes rapidly increases in a lower range of input current value. Therefore, it is preferable to supply a current to the LED that has a current value that is above such a high fluctuation range (i.e., that has a current value in a stable range of current values). Hereinafter, a current value that is a lower limit of the stable range is referred to as a "Minimum Value".

On the other hand, a current value is previously determined for current to be supplied to the LED for obtaining desirable light-emitting luminance. If the LED is driven by using a time-division driving technique such as the PWM driving technique and the mean amount of the current supplied to the LED is constant in each duty cycle, it is known that the average light-emitting luminance is almost the same even if the duty cycle ratio of the PWM driving technique changes. The "Rated Value" of current to be supplied to the LED is defined in terms of the mean value of current that is supplied to the LED to obtain desirable light-emitting luminance. That is, the "Rated Value" is a mean value of the current that must be supplied to the LED to achieve the desirable light-emitting luminance. Under such a definition, the "Minimum Value" often becomes larger than the "Rated Value".

In the "Soft-Start" driving operation, a transition period Tb is needed, during which the current value of the current supplied to the LED increases from the first constant current value A1 to the second current value A2. Including the period Ta, during which the LED is controlled with the first constant current value A1, a time period Tc of about hundreds of microseconds is needed to increase the current supplied to the LED up to the second current value A2.

Therefore, when executing the PWM driving technique, when the duty cycle is set to a relatively short time period, and when also executing the "Soft-Start" driving operation in the turned-on period Ton, the ratio of the time period Tc to the turned-on period Ton increases. That is, since the time period Tc is required to increase the current value to the second current value A2, a time period Td during which the second current value A2 is stably supplied to the LED becomes extremely short, as shown in FIG. 10. As a result, lighting of the LED becomes unstable.

SUMMARY OF THE INVENTION

According to one aspect of the invention, a light emitting element driving apparatus is provided for driving a light emitting element. The apparatus includes: (i) driving means for executing a PWM driving operation to drive the light emitting element at a predetermined duty cycle and for executing a soft-start driving operation during each ON-period in the PWM driving operation. During the soft-start driving operation, a current value of current supplied to the light emitting element is increased from a first constant current value up to a second constant current value, and (ii) parameter adjusting means for controlling the driving means such that the second constant current value is supplied to the light emitting element for a period that is longer than a period from a beginning of the ON-period to a time at which the current value of the current supplied to the light emitting element reaches the second constant current value.

In the light emitting element driving apparatus, the parameter adjusting means includes second constant current adjusting means for setting the second constant current value to a current value that is not lower than a lowest limit value of current in the soft-start driving operation, and duty cycle adjusting means for adjusting the ON-period in the PVVM driving operation such that an average value of current supplied to the light-emitting element when the PWM driving operation is executed with the second constant current value adjusted by the second constant current adjusting means if the soft-start driving operation is not executed is substantially equivalent to a rated value for the light emitting element.

In the light emitting element driving apparatus, the second constant current adjusting means adjusts the second constant current value such that the driving means supplies the second constant current value to the light emitting element at least for a period that is longer than the period from the beginning of the ON-period to the time at which the current value of the current supplied to the light emitting element reaches the second current value during the ON-period set by the duty cycle adjusting means, and the driving means executes the PWM driving operation in accordance with the ON-period set by the duty cycle adjusting means and executes the soft-start driving operation with the second current value adjusted by the second constant current adjusting means.

According to another aspect of the invention, a method of driving a light emitting element is provided which includes: (i) executing a PVVM driving operation to drive the light emitting element at a predetermined duty cycle, and executing a soft-start driving operation during each ON-period in the PWM driving operation, wherein during the soft-start driving operation a current value of current supplied to the light emitting element is increased from a first constant current value up to a second constant current value; and (ii) controlling parameters of the duty cycle and the second constant current value such that the second constant current value is supplied to the light emitting element for a period that is longer than a period from a beginning of the ON-period to a time at which the current value of the current supplied to the light emitting element reaches the second current value.

According to still another aspect of the present invention, a computer readable recording medium is provided which stores a computer program. The computer program is executable by a computer to cause the computer to control a light emitting element by executing functions including: (i) executing a PWM driving operation to drive the light emitting element at a predetermined duty cycle; (ii) executing a soft-start driving operation during each ON-period in the PWM driving operation, wherein during the soft-start driving operation a current value of current supplied to the light emitting element is increased from a first constant current value up to a second constant current value; and (iii) controlling parameters of the duty cycle and the second constant current value such that the second constant current value is supplied to the light emitting element for a period that is longer than a period from a beginning of the ON-period to a time at which the current value of the current supplied to the light emitting element the second current value.

BRIEF DESCRIPTION OF THE DRAWINGS

The accompanying drawings illustrate preferred embodiments of a light emitting element driving apparatus according to the invention, and together with the detailed description of the preferred embodiments given below serves to explain the principles of the invention.

FIG. 6 is a table illustrating an example of adjustment second constant current value and the turned-on period.

DETAILED DESCRIPTION

Figure 1:
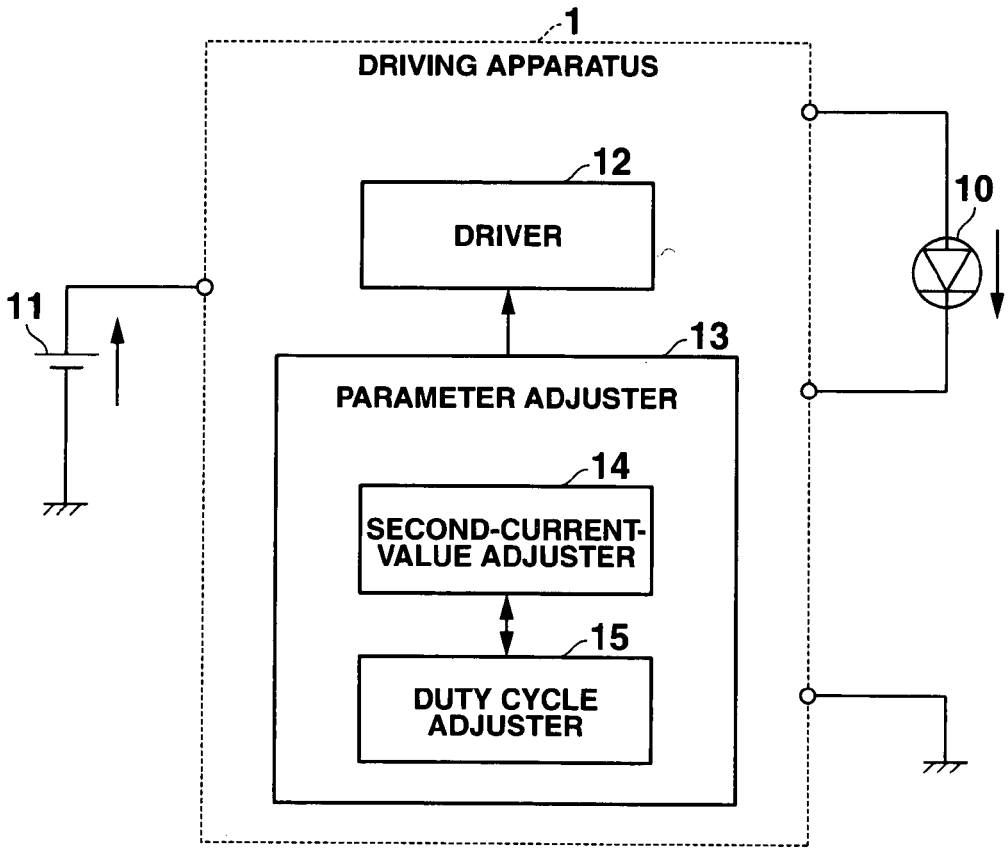
FIG. 1 is a diagram showing functional blocks of a light emitting element driving apparatus.

A first embodiment of a driving apparatus 1 and a method for driving an LED according to the present invention will be described in detail with reference to the accompanying drawings. FIG. 1 is a functional block diagram of the driving apparatus 1, which has a built-in voltage booster type circuit and microcomputer. The driving apparatus 1 includes a driver 12 for driving an LED 10 which serves as a light emitting element, and a parameter adjuster 13. The driver 12 boosts a DC voltage of a DC power supply 11 and supplies the boosted DC voltage to the LED 10. The parameter adjuster 13 adjusts predetermined parameters for the driver 12 to drive the LED 10.

The driver 12 executes a PWM driving operation at a predetermined duty cycle Dt to drive the LED 10 based on various parameters adjusted by the parameter adjuster 13. In addition, the driver 12 performs a "Soft-Start" driving operation, in which the current value of current supplied to the LED 10 increases from a first constant current value A1 to a second current value A2 (that is, a second constant current value) during each turned-on period Ton in the PWM driving operation.

Figure 2:
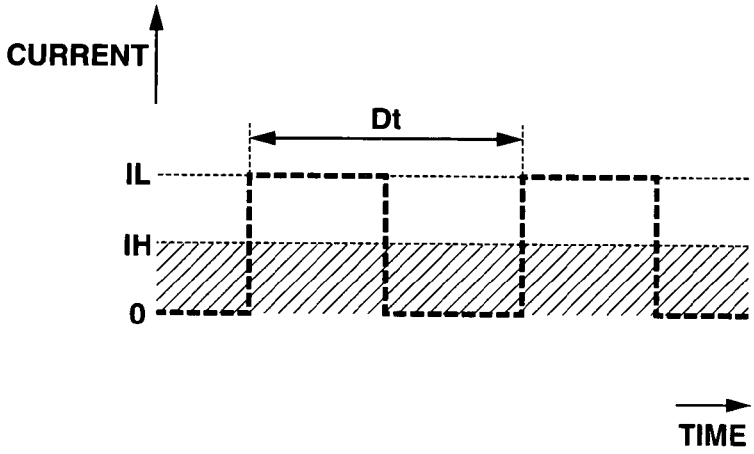
FIG. 2 is a diagram illustrating relation between a rated value and a minimum value of current supplied to an LED.

As shown in FIG. 2, the "Rated Value" IH for LED 10 to provide desirable light-emitting luminance is defined in terms of the mean value of the current supplied to LED 10 during the duty cycle Dt in the PWM driving operation. That is, the "Rated Value" IH is a value to which a mean value I-ave of the supplied current is set to provide the desirable light-emitting luminance. The "Minimum Value" IL of current supplied from the DC power supply 11 to LED 10 is defined for the driver 12 as explained above to supply current in the stable range (to avoid large fluctuations in the current). The "Minimum Value" IL is, for example, set as a current value of current which is supplied to LED 10 such that output current fluctuates within a fluctuation range of 20% in a temperature variation of ±20 degrees about (with respect to) room temperature. It is assumed that "Rated Value" IH is set to a lower value than "Minimum Value" IL. Hereafter, the driving apparatus according to the first embodiment will be concretely described based on the assumption that "Minimum Value" IL has been set to 100 mA and "Rated Value" IH has been set to 50 mA, However, the "Minimum Value" IL and "Rated Value" IH are not necessarily limited to these values.

The parameter adjuster 13 includes at least a second-current-value adjuster 14 and a duty cycle adjuster 15. The second-current-value adjuster 14 adjusts the second current value A2 in the "Soft-Start" driving operation. The duty cycle adjuster 15 adjusts the turned-on period Ton in the PWM driving operation.

Figure 3:
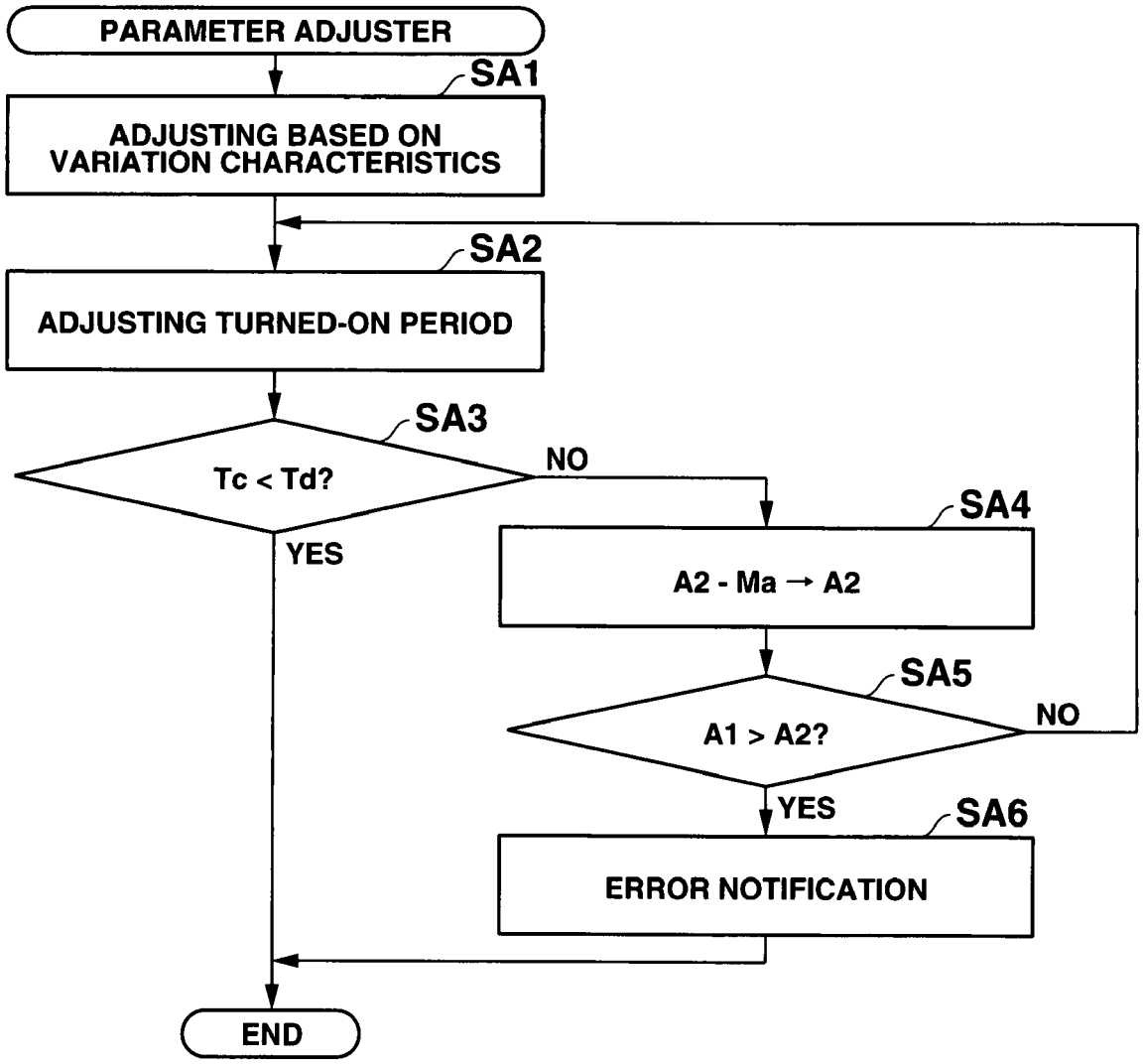
FIG. 3 is a flowchart for explaining operation of a parameter adjuster.

An operation of the parameter adjuster 13 will be described with reference to the flowchart shown in FIG. 3. It is assumed in the first embodiment that the parameter adjuster 13 stores the duty cycle Dt, the first constant current value A1, a period Ta and current-increase rate ΔA. In the period Ta of the turned-on period Ton, the first constant current value A1 is kept. The current-increase rate ΔA is a rate at which the current increases from the first constant current value A1 to the second current value A2 within a predetermined time. For example, the duty cycle Dt is stored as 1 ms, the first constant current value A1 is stored as 100 mA, the current-increase rate ΔA is stored as 1 mA/μs and the period Ta is stored as 100 μs.

It is desirable that the first constant current value A1 is set to no less than the "Minimum Value" IL of the current supplied from the DC power supply 11 to LED 10, but it is preferable that the first constant current value A1 is as low as possible to prevent inrush current. Accordingly, it is desirable that the first constant current value A1, which is stored in the parameter adjuster 13, is equivalent to or substantially the same as the "Minimum Value" IL.

Figure 9:
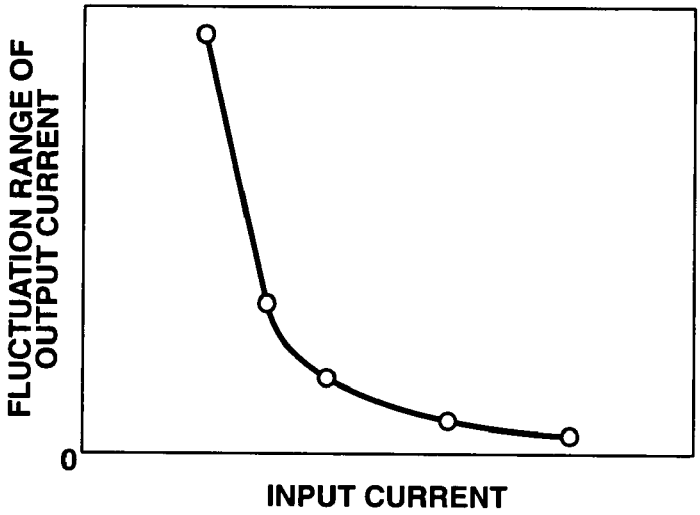
FIG. 9 is an example of a variation of characteristics of current.
Figure 10:
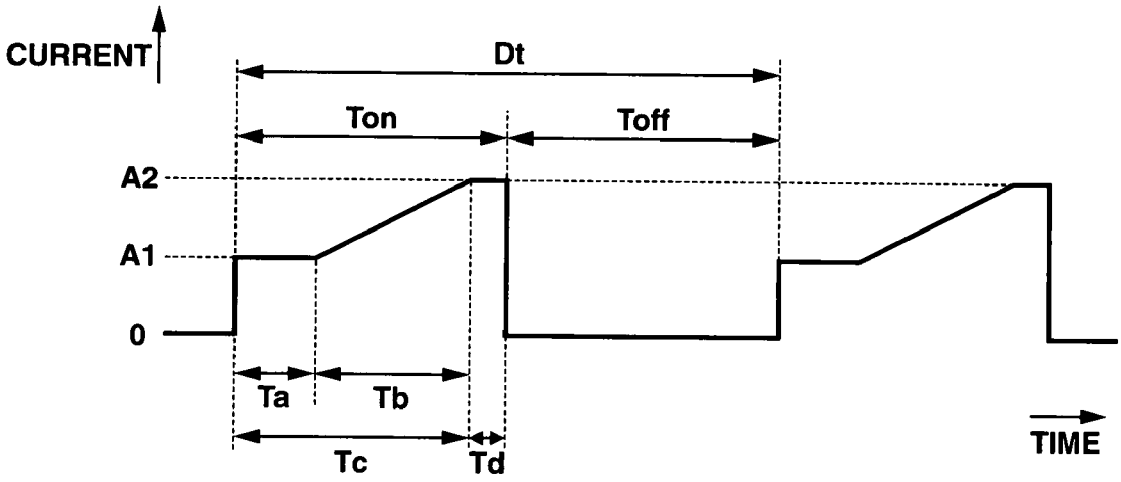
FIG. 10 is a diagram illustrating a "Soft-Start" driving operation executed during the turned on period in the PWM driving operation in which the time period during which the second predetermined current is supplied is extremely short with respect to the total turned-on period.

The second-current-value adjuster 14 adjusts the second current value A2. Initially, the second-current-value adjuster 14 adjusts the second current value A2 based on variation characteristics of the current value of the current, when the current is supplied to LED 10 from the driver 12, as exemplified in FIG. 9. (SA1) In this case, it is desirable that the second current value A2 is set to a current value with a current variation range that falls within a preferable variation range. More specially, for example, the second current value A2 is set such that the current variation range is less than 10 percent. In the first embodiment, it is assumed that the second current value A2 is set to 200 mA based on the variation characteristics of the current.

When the driver 12 executes the "Soft-Start" driving operation, the current value is increased from the first constant current value A1 to the second current value A2 during the transition period Tb, which may cause the light emitting state of the LED 10 to be unstable. During a main time period Td in which LED 10 is made to emit light stably, the current value is the second current value A2 which is set by the second-current-value adjuster 14 to allow the LED 10 to emit light stably. Thus, the second-current-value adjuster 14 adjusts the second current value A2 to a second current value A2 which is higher than the current value A1 (which is equal to or substantially the same as the "Minimum Value" IL), thereby improving the stability of the light emitting state of LED 10.

The duty cycle adjuster 15 adjusts a period Ton in which the LED 10 is turned on in the PWM driving operation using Formula 1 given below such that a mean current value I-ave becomes equal to the "Rated Value" IH when the driver 12 executes the PWM driving operation using the second current value A2 adjusted by the second-current-value adjuster 14 without executing the "Soft-Start" driving operation (that is, Formula 1 assumes that no "Soft-Start" driving operation is performed). (SA2) A period Toff, in which LED 10 is the turned-off in the PWM driving operation, is adjusted simultaneously at the same time as the period Ton is adjusted, as shown in Formula 1 below.

$$Ton=(IH\times Dt)/A2$$

$$Toff=Dt-Ton \qquad \text{[Formula 1]}$$

In the first embodiment, for example, an initial value of the turned-on period Ton is set to 250 μs and an initial value of the turned-off period Toff is set to 750 μs.

The driving apparatus 1 may be constituted so as to allow a user to input and set the "Rated Value" IH to the parameter adjuster 13, whereby the "Rated Value" IH (which is lower than the "Minimum Value") may be input and set, or the "Rated Value" IH may be stored in the parameter adjuster 13 in advance.

Figure 4:
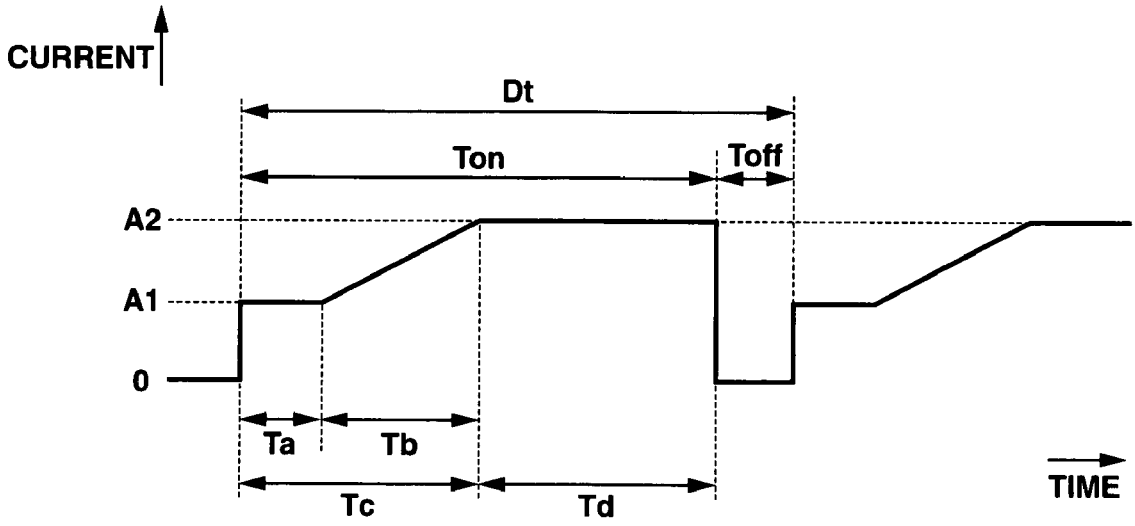
FIG. 4 is a diagram illustrating adjustment of the second constant current value.

Next, the second-current-value adjuster 14 determines whether, during the turned on period Ton set by the duty cycle adjuster 15, a time period Td (see FIG. 4), during which the current supplied to LED 10 is kept at the second current value A2, is longer than a time period Tc (see FIG. 4), which is the time period from the beginning of the turned-on period Ton to the time when the current value reaches the second current value A2. In more detail, the second-current-value adjuster 14 first calculates the transition period Tb (the period during which the first constant current value A1 is increased to the adjusted second current value A2 by the rate ΔA) by dividing the difference between the adjusted second current value A2 and the first constant current value A1 by the previously-stored current-increase rate ΔA as shown in Formula 2 below. Then, the second-current-value adjuster 14 adds the transition period Tb to the time period Ta using Formula 2 to obtain the time period Tc. And the time period Td is calculated using Formula 2 based on the turned-on period Ton and the time period Tc.

$$Tb=(A2-A1)/\Delta A$$

$$Tc=Ta+Tb$$

$$Td=Ton-Tc \qquad \text{[Formula 2]}$$

If the time period Td is determined to be longer than the time period Tc (SA3), the regulation of the second current value is ended.

On the other hand, if the time period Td is shorter than the time period Tc (SA3), a predetermined current-subtracter Ma is subtracted from a most recently set value of the second current value A2 (the initially set value of a value which has been adjusted in a previous iteration of steps SA2 to SA5) (SA4).

In particular, if the time period Tc is 200 μs and the time period Td is 50 μs, the second current value A2 (e.g., 200 mA) is adjusted (or re-adjusted) by subtracting the predetermined current-subtracter Ma (e.g., 1 mA.) from the second current value A2.

If, after the value of the second current value A2 has been adjusted (step S4), the adjusted second current value A2 is still higher than the first constant current value A1 (no in SA5), the operation returns to step SA2. On the other hand, if the adjusted second current value A2 is lower than the first constant current value A1 (yes in SA5), an error is notified and the process ends (SA6).

By carrying out the adjustment of the second current value A2 and the duty cycle Dt with the first embodiment using the values described above, as shown in FIG. 6, the second current value A2 is adjusted to 158 mA and the turned-on period Ton is adjusted to 316.5 μs.

The first embodiment described above may be modified so that when the second current value A2 becomes lower than the first constant current value A1 as a result of the adjustment performed in step S4 (yes in S5), instead of causing an error notification in step SA6 as described above, subtraction of the current-subtracter Ma from the second current value A2 is suspended, and the time period Ta, in which the first constant current value A1 is held, is omitted and a time period corresponding to the first time period Ta is added to the time period Td in which the second current value is maintained. Thus, a new duration of the second current value A2 Td(new), is calculated by adding a time period Tas corresponding to the time period Ta to the old time period Td(old) for holding the second current value A2. See FIG. 5. Then, the operation proceeds to step SA3.

In this case, the time period Tc, from the beginning of the period Ton to the time at which the current value reaches the second current value A2, is equivalent to the transition period Tb. If the time period Td is determined to be longer than the time period Tc (SA3), the regulation of the second current value is ended. Thus, according to this modification of the first embodiment, the driver 12 executes the "Soft-Start" driving operation to drive the LED 10 without the time period Ta, in which the first constant current value A1 is held.

Figure 7:
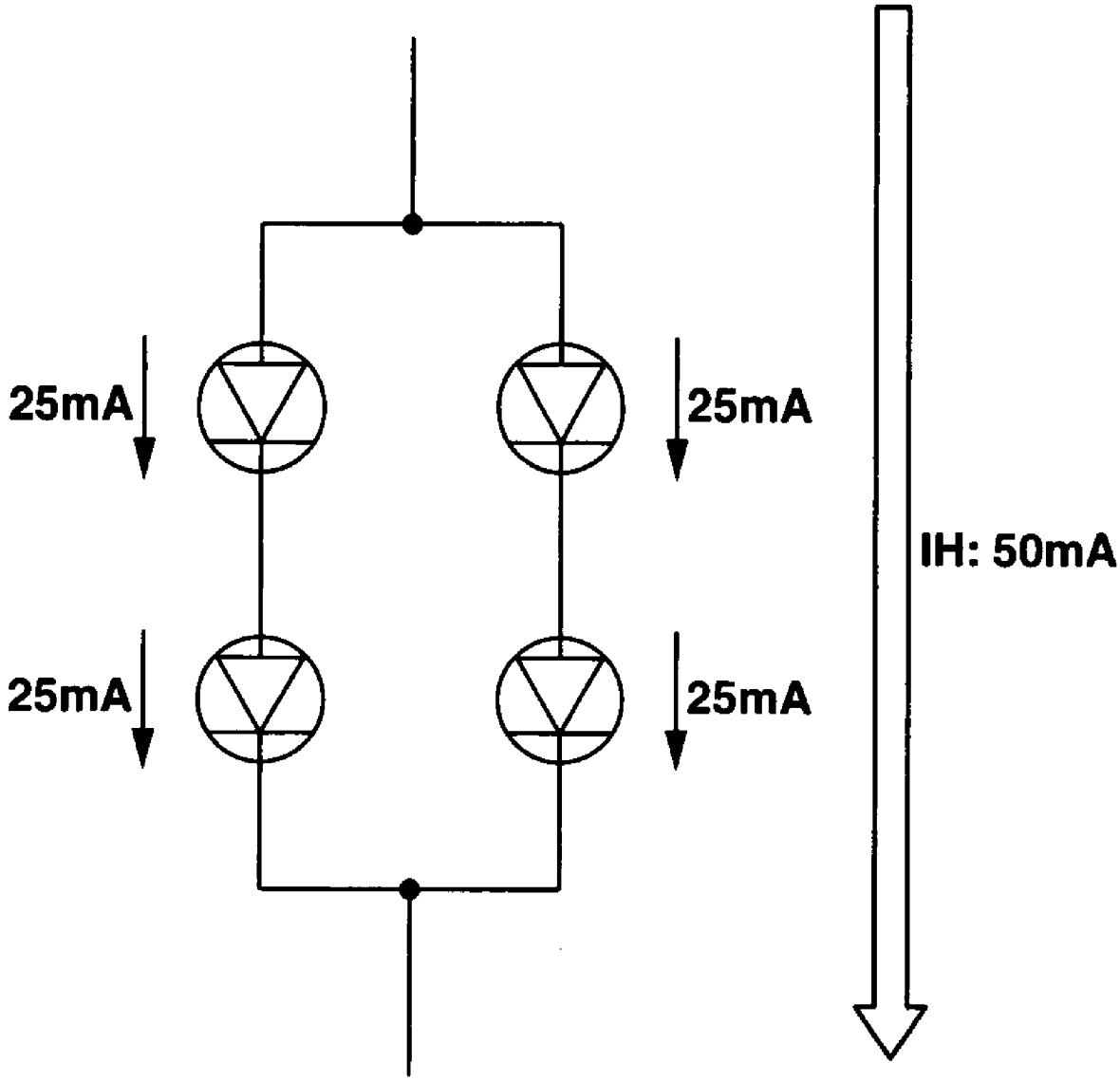
FIG. 7 is an example of a connection of multiple LEDs.
Figure 8A:
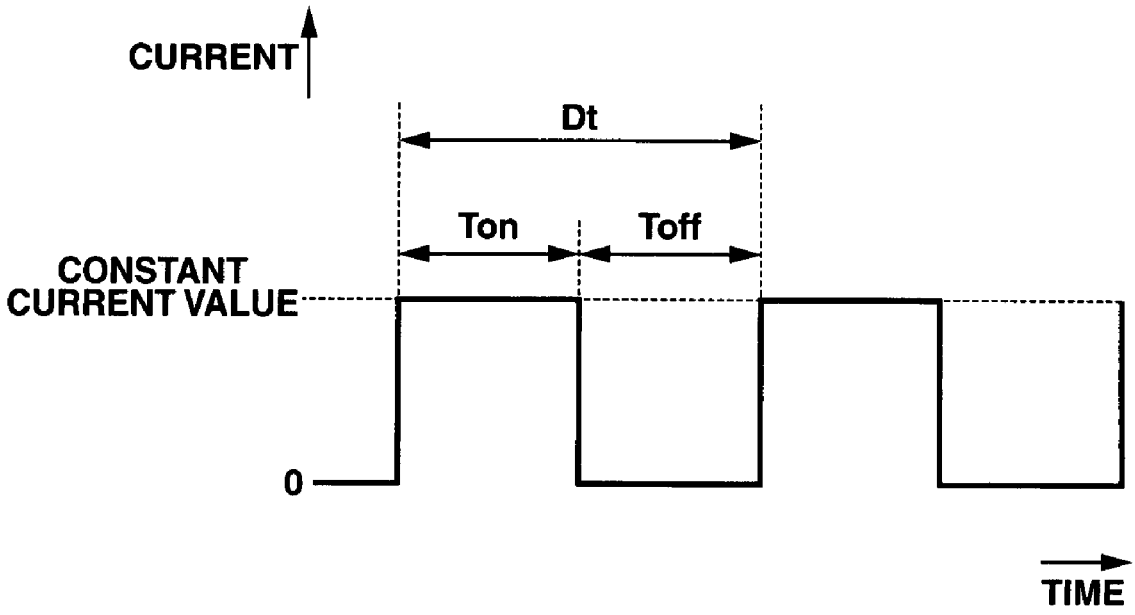
FIG. 8A is a diagram illustrating a PWM driving operation.
Figure 8B:
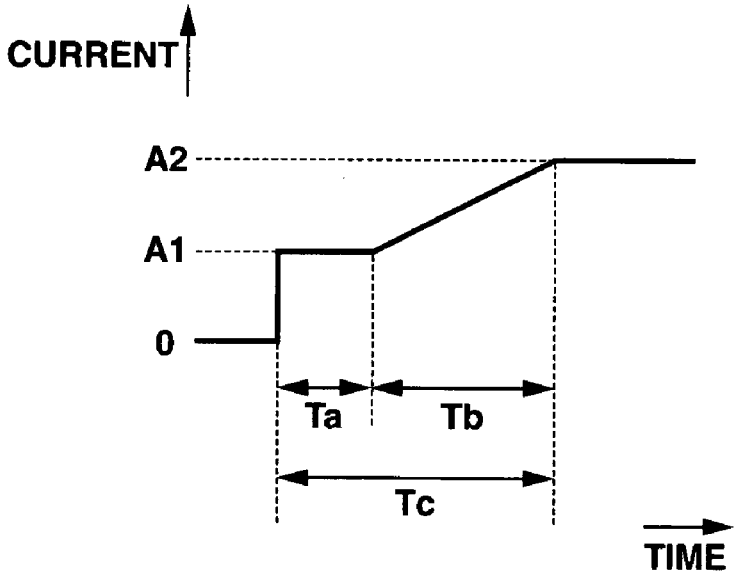
FIG. 8B is a diagram illustrating a "Soft-Start" driving operation.

In addition, when a plurality of LEDs are connected to the LED driving apparatus as shown in FIG. 7, it is desirable to set the "Rated Value" to the integrated current value of the "Rated Values" of the LEDs. That is, if two LEDs are connected in series and a pair of these series-connected LEDs are connected in parallel (see FIG. 7), and the "Rated Value" of each LED is 25 mA, the integrated value of the "Rated Value" for all four LEDs is 50 mA.

Still further, it is possible to calculate Ton using the following Formula 3 in place of Formula 1 described above.

$$Ton=(IH\times Dt+Ta\times(A2-A1)+Tb\times(A2-A1)/2)/A2$$

where $Tb=(A2-A1)/\Delta A$ *[Formula* 3]

Using Formula 3, it is possible to adjust Ton more precisely to make I-ave, which is the mean current value while the PWM driving is executed, equal to the "Rated Value" IH.

In the first embodiment, as described above, the second current value A2 is adjusted such that the time period Td is longer than the time period Tc. That is, the condition set in step SA3 is merely that Tc is less than Td. However, the present invention is not limited to this feature. For example, it is possible to adjust the time period Td to be longer than the time period Tc by a predetermined rate of the time period Tc. It is also possible to adjust the time period Td to be longer than the time period Tc by a predetermined time period, for example, 50 μs.

Further, in the first embodiment, it is possible to adjust the second current value A2 by adding a predetermined additional current Mb to the second current value A2, instead of subtracting the predetermined current-subtracter Ma from the second current value A2. In this case, it is possible to modify the first embodiment such that the predetermined additional current Mb is added to the second current value A2 as long as a desirable condition is satisfied, for example, a condition that the time period Td is longer than the time period Tc.

Figure 5:
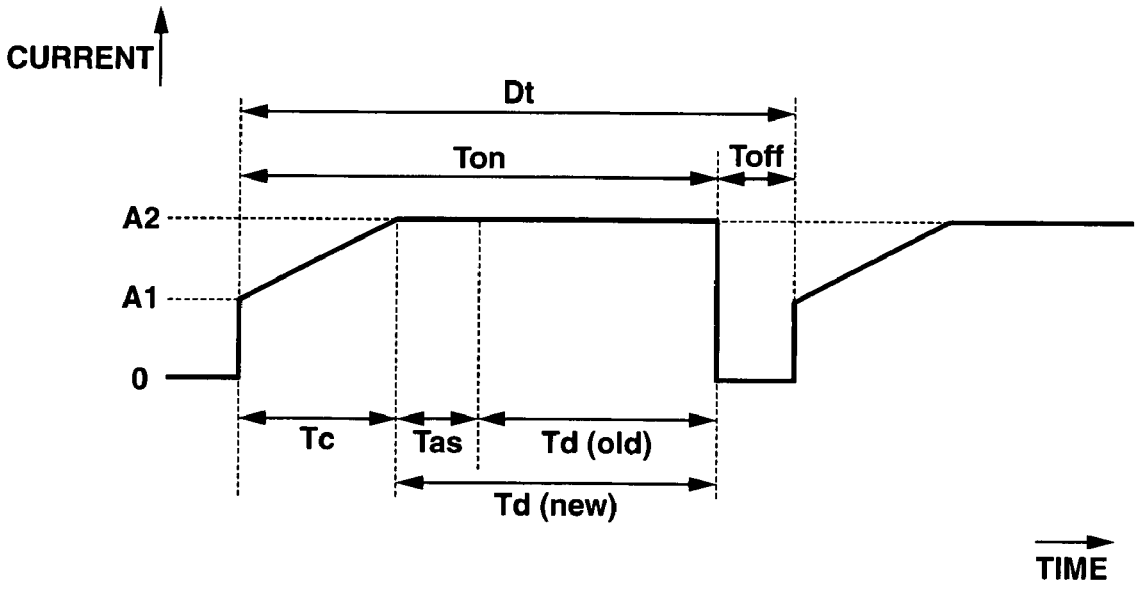
FIG. 5 is a diagram illustrating each time period of a PWM duty cycle with a soft-start driving operation when a period for holding the first constant current value is added to a period for holding the second constant current value.

Furthermore, in the first embodiment, when the second current value A2 is caused to be lower than the first constant current value A1 by subtracting the predetermined current-subtracter Ma (SA4 and SA5) the modification of the first embodiment shown in FIG. 5 may be modified further by, instead of setting a length of the period Ta to 0 as shown in FIG. 5, performing (and repeating as necessary) of subtracting a predetermined time period from the time period Ta and adding the predetermined time period to the time period Tas, whereby the time period Ta decreases gradually and the time period Td increases gradually.

With the parameter adjuster 13 of the first embodiment described above, the second constant current value is adjusted by the second-current-value adjuster 14 and the turned-on period is adjusted by the duty cycle adjuster 15. However, for example, parameters such as the "Minimum Value" IL, the "Rated Value" IH, the duty cycle Dt, the first constant current value A1, the current-increase rate ΔA, the second current value A2 and the turned-on period Ton can be preliminarily calculated to keep the time period Td longer than the time period Tc, and stored in the driver. In this case, the driver merely executes the "Soft-Start" driving operation according to the stored parameters.

In any event, in order to practice any of the various possible embodiments of the present invention, it is sufficient for the driver to execute the "Soft-Start" driving operation by keeping the second current value at least for a time period that is as long as a time period from the beginning of the turned-on period Ton to the time when the current value comes up to (reaches) the second current value, or longer.

When, in accordance with the practice of the various embodiments of the present invention, the rated value, as the mean value of current that must be supplied to the light-emitting device from the driving apparatus during the duty cycle in the PWM driving operation to achieve a desirable light-emitting luminance, is set to a lower value than the minimum value of current supplied from the driving apparatus to the light-emitting device during the turned-on period Ton in the PWM driving operation, it is sufficient for the driver to execute the "Soft-Start" driving operation by keeping the second current value at least for the time period that is as long as the time period from the beginning of the turned-on period to the time when the current value comes up to the second current value, or longer, during the turned-on period Ton in the PWM driving operation, while satisfying the condition whereby the rated value is lower than the minimum value.

The driving apparatus described above may be used in various light-emitting devices using a light-emitting device, such as digital cameras, mobile terminal devices and the like.

Further, in the embodiments described above, a computer program may be used as a driver for driving a light emitting device, whereby a PWM driving operation is executed to drive the light emitting device with a predetermined duty cycle and a "Soft-Start" driving operation is executed, in which a current value of current supplied to the light emitting device increases from a first constant current value to a second current value during each turned-on period in the PWM driving operation, wherein the driver executes the "Soft-Start" driving operation, in which the second constant current value is kept at least for a time period that is as long as a time period from the beginning of the turned-on period to a time when the current value comes up to the second constant current value, or longer, during the turned-on period in the PWM driving operation.

In accordance with the present invention, it is possible to provide a driving apparatus for light emitting devices, a driving method for light emitting devices and/or a driving program for light emitting devices which can make light emitting devices emit light stably by performing a "Soft-Start" driving operation, even if there is a limitation on the current value of the current supplied during a given duty cycle.

What is claimed is:

1. A light emitting element driving apparatus for driving a light emitting element, comprising:

driving means for executing a PWM driving operation to drive the light emitting element at a predetermined duty cycle and for executing a soft-start driving operation during each ON-period in the PWM driving operation, wherein during the soft-start driving operation a current value of current supplied to the light emitting element is increased from a first constant current value up to a second constant current value; and parameter adjusting means for controlling the driving means such that the second constant current value is supplied to the light emitting element for a period that is not shorter than a period from a beginning of the ON-period to a time at which the current value of the current supplied to the light emitting element reaches the second constant current value.

2. The light emitting element driving apparatus according to claim 1, wherein a rated value defined in terms of an average current value that is supplied to the light-emitting element by the driving means during each of duty periods in the PWM driving operation is set lower than a lowest limit value of the current supplied to the light emitting element by the driving means during each ON-period in the PWM driving operation.

3. The light emitting element driving apparatus according to claim 2, wherein the parameter adjusting means comprises:

second constant current adjusting means for setting the second constant current value to a current value not lower than the lowest limit value; and duty cycle adjusting means for adjusting the ON-period in the PWM driving operation such that an average value of the current supplied to the light-emitting element when the PWM driving operation is executed with the second constant current value adjusted by the second constant current adjusting means if the soft-start driving operation is not executed is substantially equivalent to the rated value.

4. The light emitting element driving apparatus according to claim 3, wherein:

the second constant current adjusting means adjusts the second constant current value such that the driving means supplies the second constant current value to the light emitting element at least for a period that is longer than the period from the beginning of the ON-period to the time at which the current value of the current supplied to the light emitting element reaches the second current value during the ON-period set by the duty cycle adjusting means; and the driving means executes the PWM driving operation in accordance with the ON-period set by the duty cycle adjusting means and executes the soft-start driving operation with the second current value adjusted by the second constant current adjusting means.

5. The light emitting element driving apparatus according to claim 4, wherein the second constant current adjusting means adjusts the second constant current value based on a variation characteristic of the current output from the driving means.

6. The light emitting element driving apparatus according to claim 2, wherein the lowest limit value is set to a current value such that the current output from the driving means shows a predetermined variation characteristic under a predetermined condition.

7. The light emitting element driving apparatus according to claim 3, wherein the lowest limit value is set to a current value such that the current output from the driving means shows a predetermined variation characteristic under predetermined condition.

8. The light emitting element driving apparatus according to claim 3, wherein the second constant current adjusting means adjusts the second constant current value based on a variation characteristic of the current output from the driving means.

9. The light emitting element driving apparatus according to claim 4, wherein the first constant current value is substantially equivalent to the lowest limit value.

10. A method of driving a light emitting element, comprising:

executing a PWM driving operation to drive the light emitting element at a predetermined duty cycle, and executing a soft-start driving operation during each ON-period in the PWM driving operation, wherein during the soft-start driving operation a current value of current supplied to the light emitting element is increased from a first constant current value up to a second constant current value; and controlling parameters of the duty cycle and the second constant current value such that the second constant current value is supplied to the light emitting element for a period that is longer than a period from a beginning of the ON-period to a time at which the current value of the current supplied to the light emitting element reaches the second current value.

11. A computer readable recording medium storing a computer program, which is executable by a computer, to cause the computer to control a light emitting element by executing functions comprising:

executing a PWM driving operation to drive the light emitting element at a predetermined duty cycle;

executing a soft-start driving operation during each ON-period in the PWM driving operation, wherein during the soft-start driving operation a current value of current supplied to the light emitting element is increased from a first constant current value up to a second constant current value; and controlling parameters of the duty cycle and the second constant current value such that the second constant current value is supplied to the light emitting element for a period that is longer than a period from a beginning of the ON-period to a time at which the current value of the current supplied to the light emitting element the second current value.

* * * * *